United States Patent [19]

Anderson

[11] 4,206,716

[45] Jun. 10, 1980

[54] CLAMPING ROLLER ASSEMBLY

[76] Inventor: Bruce W. Anderson, 1242 Puerto Natales, Placentia, Calif. 92670

[21] Appl. No.: 915,517

[22] Filed: Jun. 14, 1978

[51] Int. Cl.[2] ..... B63H 9/04

[52] U.S. Cl. ..... 114/102; 114/39; 308/196; 16/18 R

[58] Field of Search ..... 16/18 R, 30, 37, 31 R, 16/31 A; 308/196; 301/35 R, 35 BJ, 35 SL, 63 PW, 5.3, 5.7, 105 R; 114/39, 102, 111, 220

[56] References Cited

U.S. PATENT DOCUMENTS

| | | | |
|---|---|---|---|
| 2,659,636 | 11/1953 | Wheelis | 308/196 |
| 3,318,277 | 5/1967 | Palm | 114/102 |
| 3,416,484 | 12/1968 | Chapman | 114/220 |
| 3,477,402 | 11/1969 | LeCompte | 114/102 |

FOREIGN PATENT DOCUMENTS

| | | | |
|---|---|---|---|
| 49404 | 8/1917 | Sweden | 308/196 |

*Primary Examiner*—Trygve M. Blix
*Assistant Examiner*—D. W. Keen
*Attorney, Agent, or Firm*—Thomas W. Buckman

[57] ABSTRACT

A roller assembly adapted for securement to a cable on a sailboat, adjacent a spreader bar, to eliminate chafing or wear of a sail. A pair of identical halves comprise a free spinning roller mounted upon an axle which clamps on the cable and locates the assembly thereon. The axle is also comprised of a pair of mating halves. Mating fastener elements are provided to interlock the roller halves together about the rotary bearing surface of the axle when the clamping axle is secured to the cable.

10 Claims, 10 Drawing Figures

CLAMPING ROLLER ASSEMBLY

BACKGROUND AND SUMMARY OF THE INVENTION

This invention relates generally to sailboat fittings and more particularly to a sailboat fitting which reduces the wear on a sail caused by contact against a spreader bar.

On most sailboats of twenty feet or larger, overlapping head sail or jibs can blanket a spreader bar which is oriented so as to extend transversely from a mast holding a shroud cable outwardly from the mast. This condition of blanketing the spreader particularly occurs when "close-hauled", namely when the sail is stretched as tightly as possible from bow to stern when sailing into the wind. When the sail is stretched tightly against the spreader and contacts the spreader at the point of junction between the spreader and the shroud lines, a chafe wear point is created causing the sail to wear unusually at this location.

Accordingly, the point of juncture between the spreader and the shroud cable should be reinforced in some way to prevent unusual wear on the sail. Prior art efforts to reduce wear consist of spreader boots which are rubber protection at the juncture of the wood or aluminum spreader and the stranded metal cable. While such boots do eliminate the wood/metal contact against the sail, they do not totally prevent localized wear of the sail at that region. A similar technique to prevent wood/metal to sail contact involves merely covering the juncture with a flexible tape. This also has the disadvantage that it does not totally prevent the localized wear on the relatively expensive sail.

One roller-type prior art device is utilized in this environment and consists of a pair of mating halves of an annular ring clamped together above a stopper element which is itself clamped to the cable. The roller includes an internal bearing surface which rotates directly about and in contact with the cable and is not axially retained relative to the cable or stopper except by the force of gravity causing it to tend to rest against the top surface of the stopper. Such a device, because of its direct rotary bearing surface on the cable, tends to have more turning resistance and creates a rapidly wearing bearing surface at the bore of the roller.

The present invention is directed to an improvement in a roller assembly for securement adjacent to spreader bars. It is, accordingly, an object of the invention to provide a roller assembly for attachment to a shroud providing a smooth, wear-resistant bearing surface for a sail.

Still a further object of the invention is a wear-resistant bearing surface for a sail which is rotatably mounted on an axle which is fixedly mounted on a shroud, thus eliminating a wear surface between the roller and the shroud.

Still a further object of the invention is to provide a wear-resistant roller assembly which is easily mounted on the shroud of the sailboat.

The objects and advantages of the above invention are obtained by a roller assembly including an annular roller member and a roller mounting axle member. Each of said members comprises a pair of mating substantially identical half sections adapted to be secured to one another substantially at the diameter of the roller and axle and surrounding the shroud. The mounting axle includes a stub shank extending in one direction from a clamping region. The roller is mounted about the stub shank and the stub shank and roller bore includes means to prevent axial movement relative to one another and further include a rotary bearing surface relationship between the shank and the bore of the roller.

These and other objects and advantates of the invention will be readily understood as the following description is read in conjunction with the accompanying drawings wherein like reference numerals are used to designate like elements throughout the several views.

DETAILED DESCRIPTION OF THE PREFERRED EMBODIMENT

Figure 1:
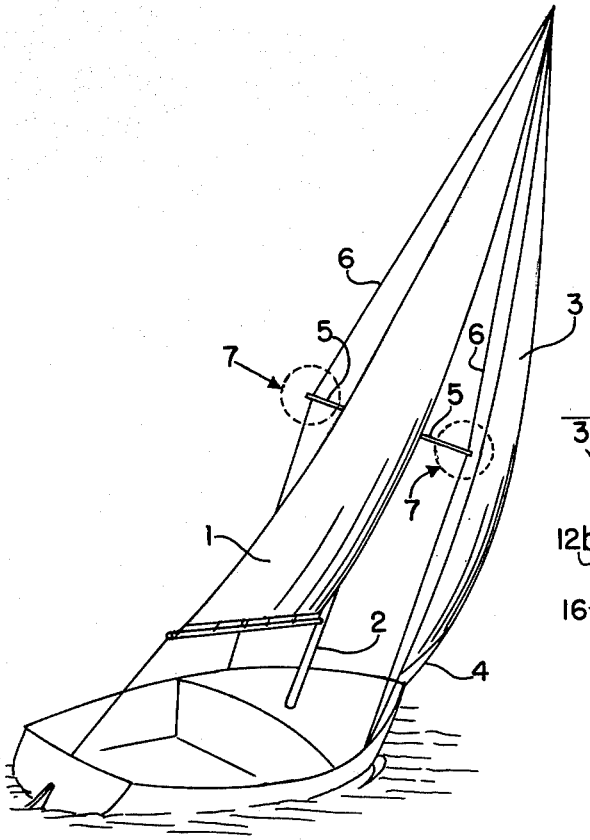
FIG. 1 is a perspective view of a sailboat showing the general location of the roller assembly of the invention.

Referring now to the drawings, FIG. 1 illustrates a sailboat, highlighting the area in which the invention is utilized. A typical sailboat of the class shown includes a mainsail 1 attached to an upstanding mast 2 and further includes a jib sail 3 secured to a forestay cable or other supporting device 4. Spreader bars of aluminum or wood 5 are secured to the mast and extend transversely thereof with the outer extremities of the spreader associated with a shroud cable 6. It is the juncture region 7 between the shroud cable 6 and spreader bars 5 that the invention is concerned with.

As pointed out above, the jib sail 3 tends to rub against the spreader bar 5 during certain conditions of sailing. The spreader roller assembly 10 shown in FIG. 2 uniquely resists the localized wear on the sail by eliminating rubbing contact between the spreader 5 and/or cable 6 and the sail 3. The relative movement between the sail and juncture 7 is, by virtue of this invention, distributed over a roller element 12 which is part of the assembly 10.

Figure 2:
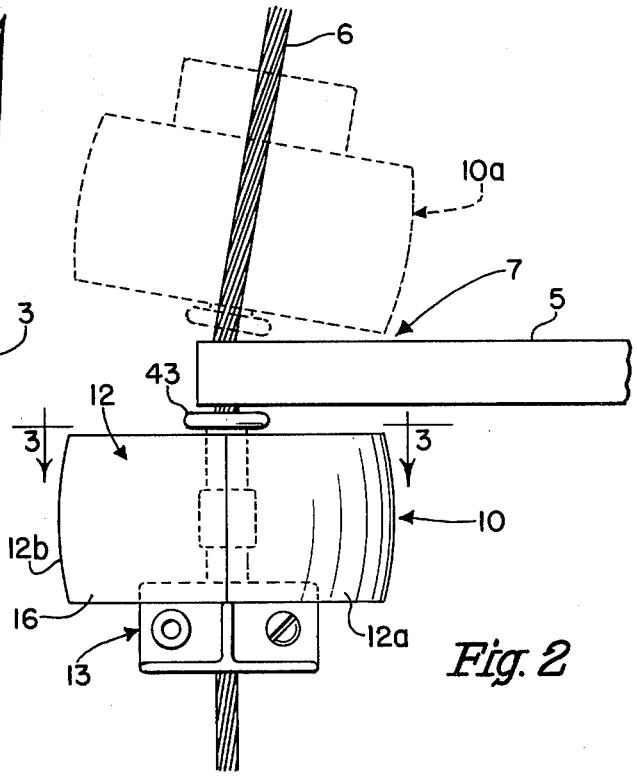
FIG. 2 is a side elevational view of the roller assembly of the invention secured to a shroud line adjacent the spreader bar and also showing an alternate location of the invention in dotted line configuration.

As noted in FIG. 2, the assembly 10 can be alternately positioned on the cable closely adjacent and either above or below the spreader bar 5. The dotted line configuration **10*a*** indicates such an upper alternate embodiment location for the invention.

Figure 3:
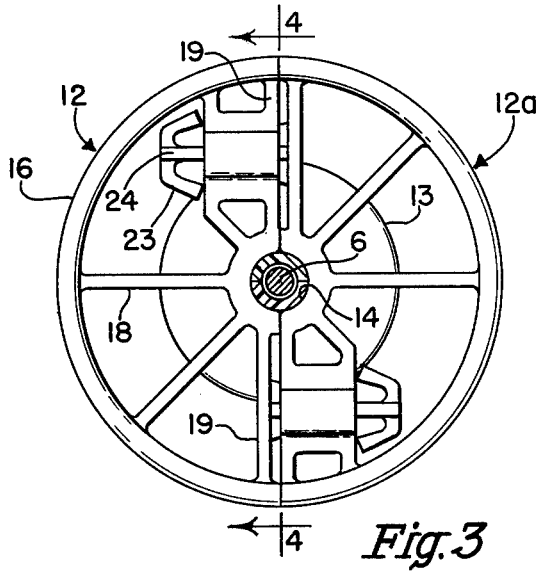
FIG. 3 is a top plan view as taken in the direction of lines 3—3 of FIG. 2 showing the roller assembly clamped about the shroud.
Figure 4:
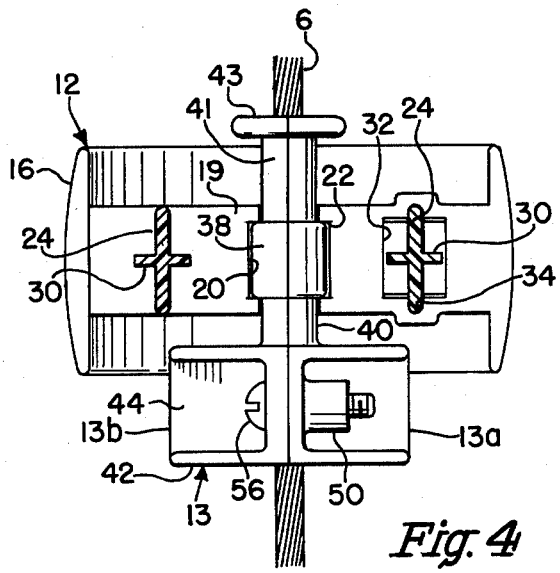
FIG. 4 is a partial axial sectional view of the roller assembly as taken along the lines 4—4 of FIG. 3.

Turning now to FIGS. 3 and 4, the basic elements of the invention will be described. Assembly 10 consists of a roller member 12 and a roller mounting axle member 13 as will be described later herein. Each of these members comprise a pair of substantially identical half sections adapted to be secured together surrounding the cable 6. In the preferred embodiment, each member 12 and 13 is generally annular in plan view and is each configured to include a centrally extending bore.

The roller member will be seen to include a broad outer rim 16 having a generally convex peripheral surface. The rim is integrally interconnected to a central bore 14 by a plurality of radially extending spokes 18 and a diametral chord 19. The completed roller member is obtained by interconnecting two half sections at the opposing diametral chords 19.

The axle member is also generally annular in configuration but includes a stub shank 38 extending on one side of a clamping region. The clamping region basically includes a pair of axially spaced radial flanges 42 which are interconnected by integral radially extending ribs 44. In a manner similar to the roller assembly, the axle member is comprised of a pair of substantially identical half sections connected at opposing diametral chords. The bore of the roller member interacts with the stub shank 38 providing a roller bearing surface between the two members and eliminating frictional contact between the roller and the cable 6. The axle member and bore of the roller member also include means, such as a reduced shank portion 40 on an axle and spaced shoulder regions 22 on the roller to retain the roller member axially relative to the axle member. An extension 41 may be provided on stub shank 38 terminating with a radially enlarged flange 43 creating means to space the roller from the spreader to insure free spinning of the roller.

Figure 5:
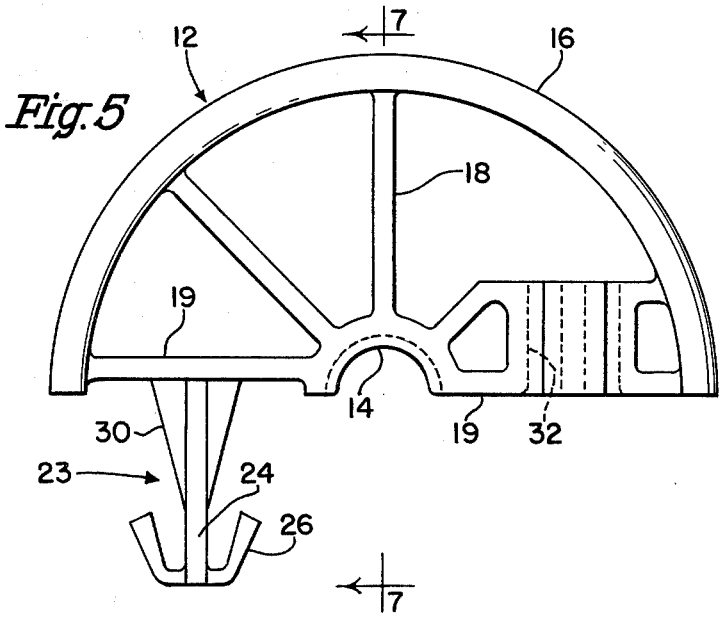
FIG. 5 is an enlarged top plan view of one of the two identical mating half sections of the roller member of the assembly.
Figure 7:
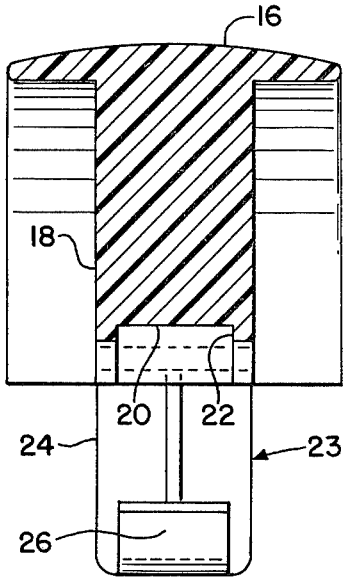
FIG. 7 is an axial cross-sectional view of the roller half section as taken along lines 7—7 of FIG. 5.
Figure 6:
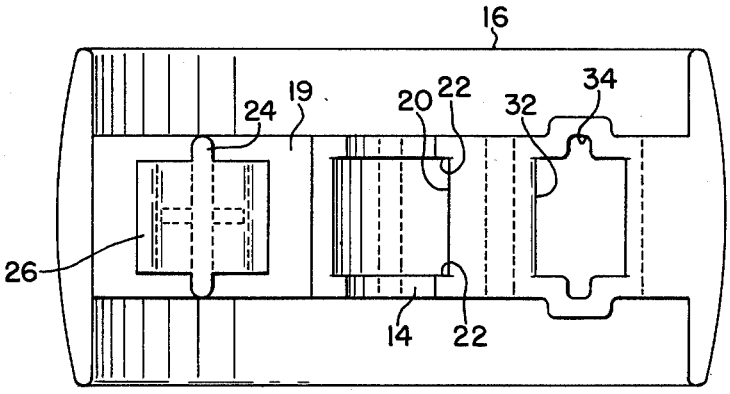
FIG. 6 is a side elevational view of the roller half section shown in FIG. 5.

Turning to FIGS. 5–7, certain structural details of one of the two identical halves of the roller member 12 will be described. It should be understood that one of the advantages of the invention is the fact that each complete roller member can be produced by identical half sections thereby facilitating the manufacture thereof. For purposes of this description, only one of such identical half sections will be described.

The central bore 14 formed by the mating of two identical sections basically includes an axially inner bearing region 20 of a half cylindrical section of a predetermined radius and axially outer regions 22 forming radial inwardly extending shoulders serving to retain the roller on the stub shank. Attention is directed to the diametral chord 19 and the means for interlocking the mating half sections of the roller. One one side of the bore 14 a region of diametral chord 19 is provided with a stud 23 extending generally perpendicular to the chord. The stud basically includes a thin rib shank 24 with a laterally compressible wing means 26 at one extremity. Reinforcement ribs 30 may be formed integral with and generally perpendicular to the shank 24. The other side of the diametral chord 19 is provided with a boss having an aperture 32 formed therein. Referring to FIGS. 6, it will be shown that the aperture 32 is generally rectangular, having a dimension in the lateral direction of the diametral chord slightly less than the uncompressed lateral dimension of the wing region 26. The dimension in the direction opposing this lateral dimension is configured as a pair of opposed grooves 34. As is shown in FIG. 7, the ribs 24 are of a width slightly greater than the width of the wings 26. Therefore, the extending widths of the ribs 24 are adapted to be received in the grooves 34 for location and stability. When the half sections of the roller member 12 are ready to be secured to this cable about the axle 38, the stud region 23 is positioned so as to generally oppose the aperture 32 in the other half. The slight force bringing the two regions together permits the stud to be inserted through the hole with wings contracting during insertion and expanding behind the hole in locked condition. This fixed condition is shown clearly in the plane view of FIG. 3.

Figure 8:
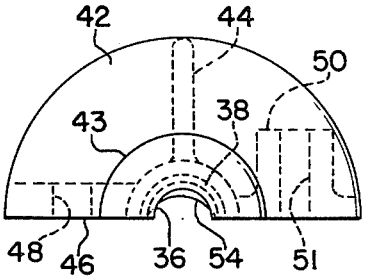
FIG. 8 is an enlarged top plan view of one of the pair of mating half sections of the roller axle and shroud clamping member.
Figure 9:
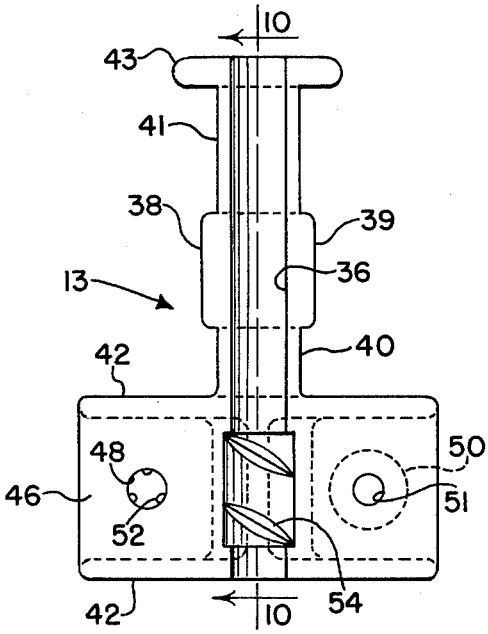
FIG. 9 is a side elevational view of the roller axle and clamping member shown in FIG. 8.
Figure 10:
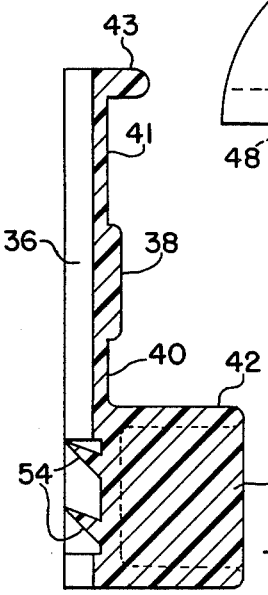
FIG. 10 is an axial cross-sectional view of the roller and clamping member as taken along lines 10—10 of FIG. 9.

Turning now to FIGS. 8–10, a further important feature of the invention, namely, the roller axle, will be described. Axle member 13 provides two important features to the invention. It first provides a rotary bearing surface for the roller to rotate about the cable and it secondly secures the assembly in a firm location on the cable. The axle member, through the interaction of the bore of the roller 14 and the stub shank of the axle 38, unitizes the axle and roller by locking the roller member axially relative to the axle. Axle 13, when assembled on the cable, includes a through bore 36 which surrounds the cable 6. Each half includes a clamping region of the bore in the vicinity of the flanges 42 and ribs 46. The clamping region will include a rib or plurality of radially inwardly extending ribs 54 which aggressively contact the associated cable to reliably secure the axle in a fixed position on the cable and accommodate a range of diameters of cable. The ribs are preferably diagonal to the axis so as to present a perpendicular clmping arrangement relative to the helically twisted stranded cable 6. Each half of the axle, like the roller member, includes a diametral chord 46 extending on either side of the half bore. One side of the chord will include a through hole 48 which may be configured to include a plurality of radially inwardly extending protuberances or ribs 52. On the other side of the bore 36 on the diametral chord 46, is formed a boss 50 with an aperture 51 of a diameter slightly smaller than the diameter of the hole 48. In the assembled condition, as shown in FIGS. 2 and 4, a self-tapping screw 56 is inserted through the hole 48 and into tapping relationship with the aperture 51 bringing the two halves clampingly together about the cable so that the ribs 54 aggressively impinge the cable. Nibs 52 serve the purpose or preassemblying and holding the tapping fastener 56 in a hole 48 in readiness for the actual tapping operation, which may be very cumbersome in view of the location of the spreader bar from the deck of the sailboat.

As noted above, the stub shank 38 provides the rotary bearing surface for the roller member 12. The axial retention capability of the axle is obtained through the reduced neck portion 40, which allows the radially enlarged bearing surface 39 to mate with the cylindrical bearing surface 20 in the roller while permitting the shoulders 22 to retain the lower regions of the stub on the roller by abutment with the shoulders at the juncture of enlarged region 39 and reduced neck region 40.

Therefore, in operation, the pair of identical axle members 13 are secured in the desired position on the cable 6 through the use of clamping screws 56. The pair of identical half sections of the roller 12 are then positioned about the shank 38 and are forced together so that the stub shanks 23 are received in an associated opposing apertures 32 permitting the compressible wing members 26 to snappingly expand behind the boss which forms the apertures 32.

This invention permits the outer rim 16 to be of a substantial width in the axial direction of the assembly and is preferably convex to enhance the frictionless contact between the sail and the assembly.

Because of the environment, the two pairs of mating identical members are preferably molded from an ultraviolet resistant thermoplastic material, therefore providing inherent lubricity for the bearing surfaces as well as long-lasting life in the vigorous environments anticipated.

While a specific embodiment of a roller assembly has been described which eliminates frictional chafing, localized wear, on a sail as well as providing lubricious bearing surface for a roller has been disclosed, it will be understood that various modifications within the spirit of the invention may be apparent to those skilled in the art. Therefore, it is intended that no limitations be placed on the invention except as defined by the scope of the appended claims.

I claim:

1. A roller assembly adapted for securement to a cable on a sailboat or the like adjacent a bar extending laterally from the upstanding mast which spreads the cable away from the mast, the assembly comprising a roller member and roller mounting axle member, each of said members comprising a pair of mating substantially identical half sections adapted to be secured together surrounding a length of said cable, each half section of the roller member includes a semicircular outer rim region with a diametral chord intersected at a central axis by a semicircular half bore, the chord region on one side of the half bore including a stud extending generally perpendicularly therefrom with laterally compressible wing means at its free extremity, the chord region on the other side including an aperture with a first transverse dimension slightly less than the maximum uncompressed lateral dimension of the wing means to accept and snappingly retain the stud from the opposing mating half section and thereby assemble one half section to one another at a diametral axial plane with a central bore of said roller member surrounding and axially retained on the axle member, the axle member half sections including means to clampingly retain said axle member to the cable in substantial nonrotative and axially fixed relationship thereto.

2. The roller assembly of claim 1, wherein the members are molded from ultraviolet resistant thermoplastic material.

3. The roller assembly of claim 2, wherein the outer rim region is of substantial width taken in the axial direction of the assembly and is convex.

4. The roller assembly of claim 1, wherein the apertures include groove means defining a second transverse dimension generally perpendicularly disposed relative to the first, the stud including rib means adapted for insertion into the groove means serving to locate and laterally position one half of the roller member relative to the other.

5. The roller assembly of claim 1, wherein each semicircular half bore includes an inner half cylindrical section bounded at each axial extremity by a semicircular radial inwardly extending shoulder thereby adapted to be mounted in a fixed axial position over the axle.

6. The roller assembly of claim 1, wherein the axle member half sections include a half bore extending axially with a mounting shaft region at one axial extremity and cable mounting regions at the other axial extremity.

7. The roller assembly of claim 6, wherein the cable mounting region of each half section of the axle member includes radially extending flanges from either side of a half bore, at least one of the half bore surfaces including rib-like protrusions adapted to aggressively contact the associated cable, the flanges on one half section of the axle member adapted to abut the other half section at a diametral chord of the axle member and include means to clamp said half sections together around the cable.

8. The roller assembly of claim 6, wherein the mounting shaft region of the axle half section includes a section of predetermined axial extent and of predetermined radial extent joined to the cable mounting region with an intermediate shaft extent of radial extent less than said predetermined radial extent.

9. The roller assembly of claim 8, including a shaft extension extending outwardly from the section of predetermined axial extent having a radial extent less than said predetermined radial extent, the free extremity of said extension including a radially extending flange creating means to space the roller from said bar.

10. The roller assembly of claim 1, wherein the interlocked roller halves include a plurality of spoke-like ribs radiating from the central bore, said ribs including the diametral chords.

* * * * *